US006247540B1

(12) United States Patent
Clemen et al.

(10) Patent No.: US 6,247,540 B1
(45) Date of Patent: Jun. 19, 2001

(54) BLADE PITCH INDICATOR

(75) Inventors: Larry Joseph Clemen; Gregory G. Miller, both of Dubuque, IA (US); Preston Harold Roberts, Toana, VA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/449,655

(22) Filed: Nov. 30, 1999

(51) Int. Cl.[7] ..... E02F 3/815
(52) U.S. Cl. ..... 172/818; 172/430; 37/906
(58) Field of Search ..... 172/818, 819, 172/823, 811, 816, 430; 403/43–48; 37/271, 266, 906, 903

(56) References Cited

U.S. PATENT DOCUMENTS

| | | | |
|---|---|---|---|
| 3,900,073 | 8/1975 | Crum | 172/430 |
| 4,828,045 | 5/1989 | Horsch et al. | 172/821 |
| 5,507,352 | 4/1996 | Frisbee et al. | 172/818 |

OTHER PUBLICATIONS

Deere & Company Operator's Manual "450H Crawler Dozer", OMT174088 B9, cover and pp. 35–1 and 35–2, printed in U.S.A., Nov. 1998.

Deere & Company Operator's Manual "450G, 550G, and 650G Torque Converter and Direct Drive Crawler Dozers", OMT159724 Issue B6, cover and pp. 35–3 and 35–4, printed in U.S.A., Dec. 1994.

Deere & Company Operator's Manual "John Deere 550B, Crawler Tractor 555B Crawler Loader", OM–T81348 Issue B5, cover and pp. 31–32, printed in U.S.A., date unknown.

Deere & Company Operator's Manual "750C and 850C Crawler Dozer" OMT162109 E7, cover and pp. 35–3 and 35.4, printed in U.S.A., Jun. 1996.

*Primary Examiner*—Christopher J. Novosad

(57) ABSTRACT

A blade pitch indicator is releasably secured to a linear actuator in the form of a turnbuckle. The blade pitch indicator comprises a cover having protrusions forming arrow points that line up with a line of demarcation on the linear actuator. Indicia is associated with the protrusions to provide blade pitch positioning information to the operator. The turnbuckle is provided with two moveable yokes and a stationary threaded shaft. The threaded shaft is rotated to extend and retract the yokes, thereby adjusting the pitch position of the bulldozer blade. The threaded shaft is provided with a multifaceted nut in the form of a hexagonal nut that is engaged by a wrench to rotate the threaded shaft. The hexagonal nut is provided with an aperture through which a pin is inserted releasably securing the cover to the turnbuckle. The arrow points of the protrusions line up with the base end of the yokes to indicate the bulldozer blade's pitch position.

14 Claims, 3 Drawing Sheets

BLADE PITCH INDICATOR

BACKGROUND OF THE INVENTION

1. Field of the Invention:

The present invention is directed to a simple blade pitch indicator for a bulldozer blade which is mounted to the linear actuator for changing the pitch of the blade.

2. Description of the Prior Art:

Work vehicles, such as crawler tractors and wheel tractors, may be equipped with bulldozer blades for pushing dirt and other materials. It is desirable to adjust the pitch of the blade for different operations and conditions. On utility crawler dozers, the assignee of the present patent application has provided specialized three hole pinning links to adjust the pitch position or three different pitch links for three different pitch positions. Each of the three pitch links are marked to indicated the selected pitch position. In another proposed pitch adjustment configuration a two position block is used to adjust pitch between two selected positions, see U.S. Pat. No. 5,507,352.

The pitch of the bulldozer blade can be adjusted by a linear actuator moving the top portion of the blade forward and backward relative to a lower pivot point. The assignee of the present patent application has provided screw jacks to adjust the pitch of a bulldozer blade. In addition, hydraulic cylinders have also been proposed to adjust blade pitch, see U.S. Pat. No. 3,900,073. In this proposed design, the operator is provided with a blade pitch indicator located adjacent to the operator's cab.

SUMMARY OF THE INVENTION

It is an object of the present invention to provide a simple and inexpensive blade pitch indicator that can be readily viewed by the operator.

The blade pitch indicator of the present invention is releasably secured to a linear actuator for controlling blade pitch. The blade pitch indicator comprises a cover having protrusions forming arrow points that line up with a line of demarcation on the linear actuator. Indicia is associated with the protrusions to provide blade pitch positioning information to the operator. In the preferred embodiment, the linear actuator is a turnbuckle having two moveable yokes and a stationary threaded shaft. The threaded shaft is rotated to extend and retract the yokes, thereby adjusting the pitch position of the bulldozer blade. The threaded shaft is provided with a multifaceted nut in the form of a hexagonal nut that is engaged by a wrench to rotate the threaded shaft. The hexagonal nut is provided with an aperture through which a pin is inserted releasably securing the cover to the turnbuckle. The arrow points of the protrusions line up with the base end of the yokes to indicate the bulldozer blades pitch position.

DETAILED DESCRIPTION

Figure 1:
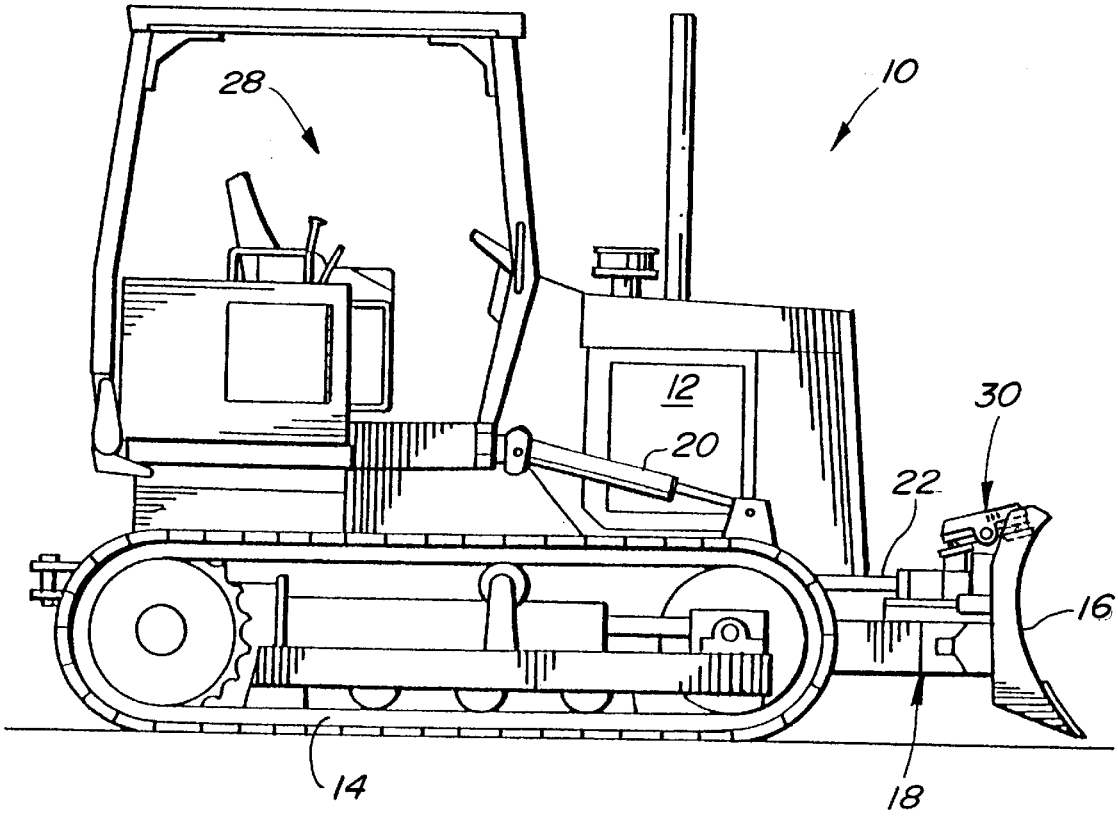
FIG. 1 is a side view of a bulldozer.
Figure 2:
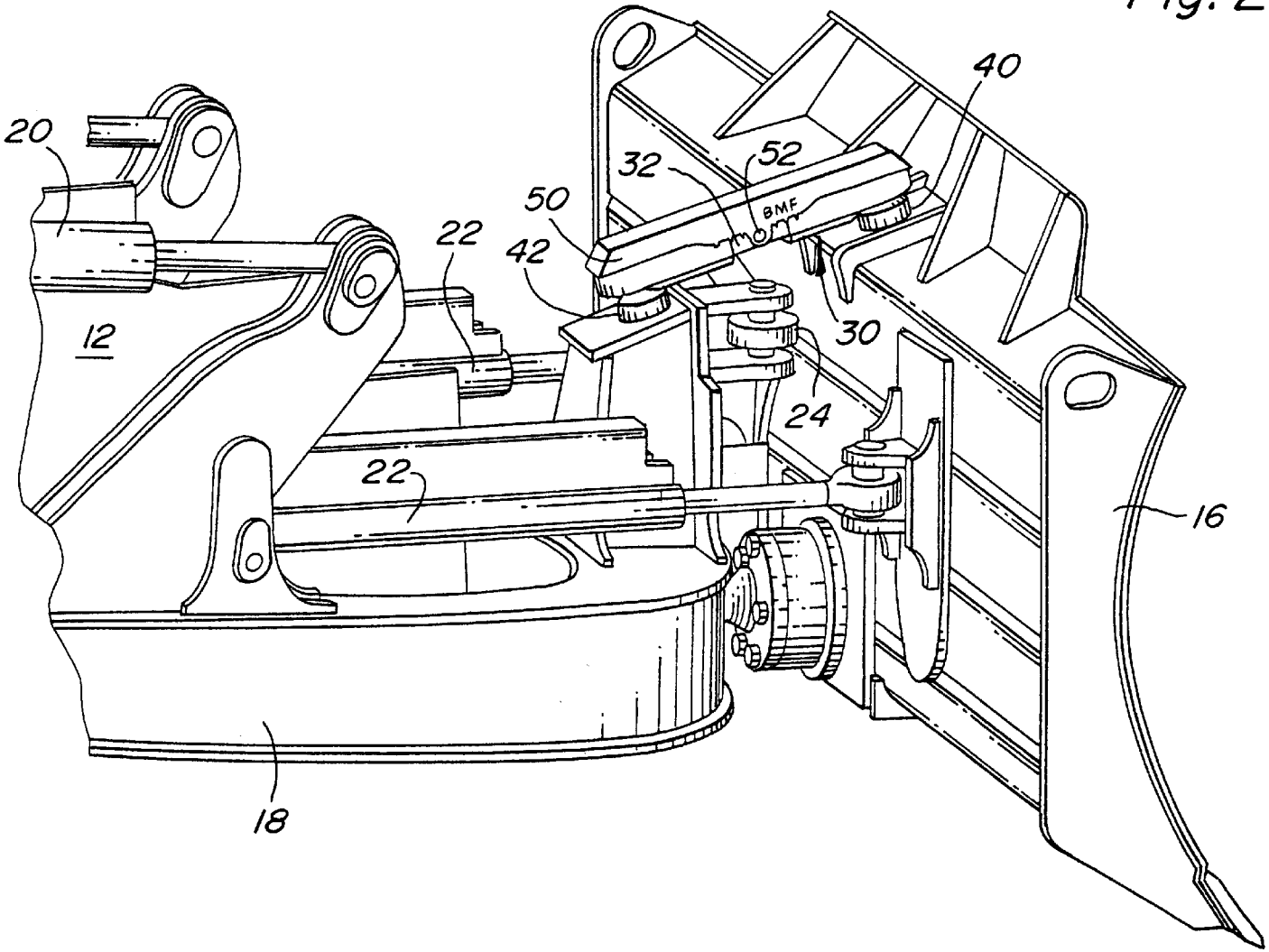
FIG. 2 is a perspective view of the bulldozer blade's control linkage.
Figure 3:
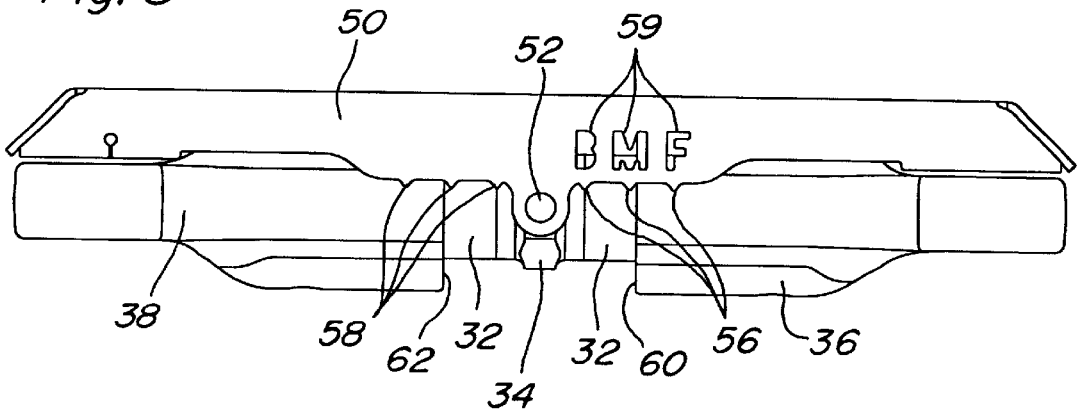
FIG. 3 is a side view of the pitch position indicator and associated turnbuckle.
Figure 4:
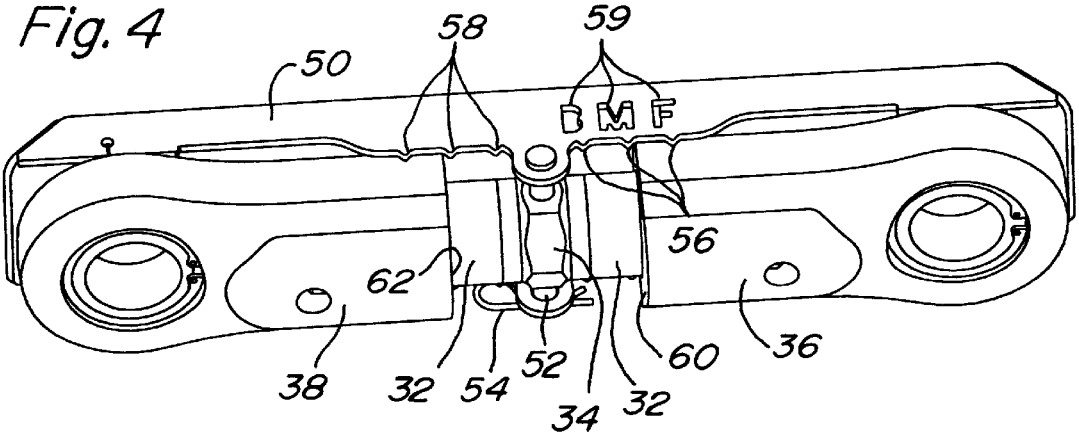
FIG. 4 is a perspective view of the pitch position indicator and associated turn buckle.

FIG. 1 illustrates a work vehicle in the form of a crawler dozer 10. The crawler dozer 10 is provided with a supporting frame 12 and ground engaging tracks 14. The ground engaging tracks may be friction or positively driven rubber belts, or conventional steel tracks. In addition, ground engaging wheels may be used in place of ground engaging tracks 14 in wheeled work vehicle applications. The dozer 10 is provided with a bulldozer blade 16 the position of which is controlled by control linkage 18. More specifically, the bulldozer blade is raised and lowered by hydraulic cylinders 20, angled by hydraulic cylinders 22 and tilted by hydraulic cylinder 24. The extension and retraction of these hydraulic cylinders is controlled by the operator through a T-bar control lever located in operators area 28.

The pitch of the blade is controlled by the extension and retraction of linear actuator 30. In the preferred embodiment the linear actuator is a turnbuckle, however hydraulic cylinders, screw jacks and electric motor powered linear actuators can also be used. The turnbuckle is of a relatively conventional configuration having a threaded shaft 32 which is provided with a multifaceted nut 34. In the preferred embodiment the multifaceted nut is a hexagonal nut. Secured to the ends of the threaded shaft 32 are first and second yokes 36 and 38, respectively. Rotating the threaded shaft extends and retracts the yokes 36 ad 38. The threaded shaft 32 is the stationary portion of the turnbuckle, whereas the yokes 36 and 38 are the moveable portions of the turnbuckle. The first yoke 36 engages top post 40 on bulldozer blade 16 and second yoke 38 engages post 42 on control linkage 18. The turnbuckle extends between the control linkage 18 and the bulldozer blade 16. As the control linkage 18 is coupled to the supporting frame 12 of the work vehicle the turnbuckle can be considered to extend between the work vehicle and the bulldozer blade 16.

Figure 5:
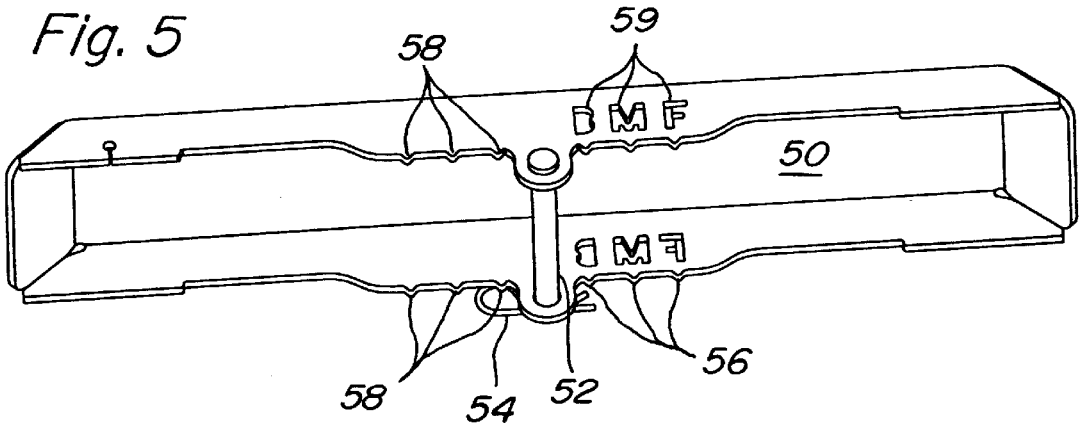
FIG. 5 is a bottom perspective view of the pitch position indicator cover.

The blade pitch indicator is a cover 50 releasably secured to the top of the turnbuckle by pin 52 and cotterpin 54. The pin 52 passes through a hole in the multifaceted nut 34. The cover 50 is provided with a first set of downwardly extending protrusions 56 and a second set of downwardly extending protrusions 58. These protrusions 56 and 58 are in the form of arrow points. Indicia 59 in the form of letters B, M and F are associated with the first set of protrusions 56 and define three blade pitch positions, back, middle and forward. These protrusions line up with a line of demarcation on the moveable portions of the turnbuckle. More specifically, these protrusions 56 and 58 line up with the base ends 60 and 62 of the yokes 36 and 38, respectively. As shown in FIG. 5, both sides of the cover 50 are provided with protrusions 56 and 58 and indicia 59. If the B protrusion of the first set of protrusions is lined up with the base end 60 of the first yoke the bulldozer blade is pitched into its back position. Similarly, if the F protrusion is lined up with the base end 60, the bulldozer blade is pitched into its forward position. As such, the cover and associated protrusions provides a simple indicator by which the operator can visually determine the pitch position of the bulldozer blade.

To change the pitch of the blade the cover 50 must be removed by removing the cotterpin 54 and pin 52 so that the operator can access the multifaceted nut 34 with a wrench. After the pitch has been adjusted the cover 50 is reinstalled.

The invention should not be limited to the above described embodiment, but should be limited solely to the claims that follow.

What is claimed is:

1. A blade pitch indicator for a bulldozer blade on a work vehicle for visually indicating a pitch position of the bulldozer blade, wherein the pitch of the bulldozer blade is adjusted by a linear actuator, the linear actuator having a stationary portion and a moveable portion, the blade pitch indicator comprising:

a cover that is secured to the stationary portion of the linear actuator, the cover is provided with a plurality of raised protrusions having associated indicia bearing marks, whereby the protrusions line up with a demarcation element located on the moveable portion of the linear actuator for indicating the pitch position of the bulldozer blade and the indicia bearing marks visually alert an operator as to the pitch position of the bulldozer blade.

2. A blade pitch position indicator as defined by claim 1 wherein the protrusions comprise arrow points that point to a demarcation element on the linear actuator.

3. A blade pitch position indicator as defined by claim 2 wherein the indicia bearing marks are letters indicating a forward pitch position, a middle pitch position and a rearward pitch position.

4. A blade pitch position indicator as defined by claim 3 wherein the linear actuator is a turnbuckle, the moveable portion comprises moveable two yokes and the stationary portion comprises a threaded shaft that can be rotated clockwise and counterclockwise to extend and retract the linear actuator by moving the yokes apart and together.

5. A blade pitch position indicator as defined by claim 4 wherein the yokes are provided with a base end, the base end forming the line of demarcation.

6. A blade pitch indicator as defined by claim 5 wherein the threaded shaft of the turnbuckle is provided with a multifaceted nut for rotating the threaded shaft to move the yokes.

7. A blade pitch indicator as defined by claim 6 wherein the cover is releasably secured to the turnbuckle by a pin passing through the multifaceted nut.

8. A blade pitch indicator as defined by claim 7 wherein the multifaceted nut is a hexagonal nut.

9. A turnbuckle for adjusting the pitch of a bulldozer blade, the turnbuckle extending between a work vehicle and the bulldozer blade for adjusting the pitch of the bulldozer blade, the turnbuckle comprising:

a threaded shaft having a first threaded end and a second threaded end, a multifaceted nut is located between the threaded ends for rotating the threaded shaft;

a first yoke is mounted to the first end of the threaded shaft, the first yoke having a first base end;

a second yoke is mounted to the second end of the threaded shaft, the second yoke having a second base end;

a blade pitch indicator having a cover with protrusions and indicia associated with each of the protrusions is secured to the threaded shaft, the protrusions being selectively in line with the first base end of the first yoke which forms a line of demarcation to informing an operator as to the pitch position of the bulldozer blade.

10. A turnbuckle as defined by claim 9 wherein the cover is provided with a first set of protrusions lining up with the first base end of the first yoke and a second set of protrusions lining up with the second base end of the second set of protrusions.

11. A turnbuckle as defined by claim 10 wherein the protrusions comprise arrow points that point to the base ends of the yokes.

12. A turnbuckle as defined by claim 11 wherein the indicia bearing marks are letters indicating a forward pitch position, a middle pitch position and a rearward pitch position.

13. A turnbuckle as defined by claim 12 wherein the cover is releasably secured to the turnbuckle by a pin passing through the multifaceted nut.

14. A turnbuckle as defined by claim 13 wherein the multifaceted nut is a hexagonal nut.

* * * * *